US010934869B2

(12) United States Patent
Tsukioka

(10) Patent No.: US 10,934,869 B2
(45) Date of Patent: Mar. 2, 2021

(54) VARIABLE STATOR VANE STRUCTURE OF AXIAL COMPRESSOR

(71) Applicant: HONDA MOTOR CO., LTD., Tokyo (JP)

(72) Inventor: Yuuri Tsukioka, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 211 days.

(21) Appl. No.: 16/355,988

(22) Filed: Mar. 18, 2019

(65) Prior Publication Data

US 2020/0040747 A1 Feb. 6, 2020

(30) Foreign Application Priority Data

Mar. 20, 2018 (JP) ..... JP2018-052430

(51) Int. Cl.
*F01D 9/04* (2006.01)
*F01D 17/12* (2006.01)

(52) U.S. Cl.
CPC ..... *F01D 9/042* (2013.01); *F01D 17/12* (2013.01); *F05D 2220/323* (2013.01); *F05D 2240/12* (2013.01)

(58) Field of Classification Search
CPC . F01D 9/02; F01D 9/042; F01D 17/12; F01D 17/162; F01D 17/165; F01D 17/167; F05D 2240/12; F05D 2240/121; F05D 2240/122; F05D 2240/22
See application file for complete search history.

(56) References Cited

U.S. PATENT DOCUMENTS 10,385,765 B2 * 8/2019 Yokoyama ..... F02C 6/12
2006/0285969 A1 * 12/2006 Maurice Ribassin ... F01D 17/16 415/160
2016/0040713 A1 * 2/2016 Boeck ..... F16C 19/463 415/148
2019/0301488 A1 * 10/2019 Batch ..... F04D 29/547

FOREIGN PATENT DOCUMENTS

JP 2000-283096 10/2000
JP 2015-045324 3/2015

* cited by examiner

*Primary Examiner* — Courtney D Heinle
*Assistant Examiner* — Sang K Kim
(74) *Attorney, Agent, or Firm* — Rankin, Hill & Clark LLP

(57) ABSTRACT

In a variable stator vane structure of an axial compressor, each stator vane (70) is provided with a shaft (72) rotatably supported by the cylindrical outer peripheral portion (14B) around an axial center line (T) of the shaft, and a vane member (74) supported by the shaft, and the axial center line of the shaft is tilted with respect to a radial line (R) extending radially from a center of the annular fluid passage (34) in a circumferential direction and/or in an axial direction of the annular fluid passage.

7 Claims, 6 Drawing Sheets

θr
T
34
72
72
74B
O
72
74
74
74A
14
34A
70
70
74C
70
74
14B
34B
14A
R
A

VARIABLE STATOR VANE STRUCTURE OF AXIAL COMPRESSOR

TECHNICAL FIELD

The present invention relates to a variable stator vane structure of an axial compressor, and in particular, to a variable stator vane structure of an axial compressor employed in a gas turbine engine for aircraft or the like.

BACKGROUND ART

The stator vanes of an axial compressor employed for a gas turbine engine for aircraft are typically designed so that the attack angle of the stator vanes is adapted to a large amount of air flow during the rated operation such as when taking off or cruising (at a high engine output). For this reason, at the time of a non-rated operation such as the time of idling or taxiing, due to a small inflow of air, the flow condition of the air at the stator vanes could be unstable due to the deviation of the air inflow condition from that of the rated operation so that compressor surge may even occur at such a time.

To overcome this problem, or in other words, to stabilize the air flow flowing through the stator vanes during a non-rated operation, various axial compressors provided with a variable stator vane structure have been proposed. See JP2000-283096A and JP2015-45324A, for instance. According to such previously proposed variable stator vane structures, each stator vane is configured to be rotatable around an axial center line coinciding with a radial line emanating radially from the center of the fluid passage typically having an annular cross section.

When the stator vanes are in the angular position for the rated operation, the clearance (gap) between the tip edge of each stator vane and the opposing wall surface of the air passage, and the clearance (gap) between the root edge of the stator vane and the opposing wall surface of the air passage are desired to be minimized in view of optimizing the performance of the compressor. Therefore, the stator vanes are normally configured and dimensioned so as to minimize such clearances (which may be collectively referred to as "tip clearance") at the time of the rated operation.

However, typically, the tip edge and the root edge of each stator vane are linear in shape while the opposing wall surfaces are arcuate as defined by circles (cylinders) centered around the axial center of the air passage. Therefore, if each stator vane is configured to be rotatable around an axial center line coinciding with a radial line emanating radially from the center of the air passage, and optimized for the rated operation (by minimizing the tip clearance), the stator vane inevitably interferes with the opposing wall surface of the air passage when the stator vane is rotated to the position corresponding to the non-rated operation.

If the root edge of each stator vane is trimmed so as to avoid the interference at the time of the non-rated operation, the tip clearance is undesirably increased at the time of the rated operation so that the pressure loss becomes unacceptably great, and the performance of the compressor is unacceptably impaired.

In the variable vane structure disclosed in JP2015-45324A, the parts of the wall surface of the air passage corresponding to the swing areas of the stator vanes are formed as concave or convex spherical surfaces so that the interference may be avoided, and the pressure loss may be minimized.

However, when such concave or convex spherical surfaces are created on the wall surface of the annular air passage, the air flow is inevitably disturbed, and this may become a new cause for pressure loss. Also, the forming of the concave or convex spherical surfaces requires additional work to be applied to the wall surface so that the manufacturing cost increases.

SUMMARY OF THE INVENTION

In view of such a problem of the prior art, a primary object of the present invention is to provide a variable stator vane structure of an axial compressor that can minimize pressure loss without substantially increasing the manufacturing cost.

To achieve such an object, the present invention provides a variable stator vane structure of an axial compressor, comprising: a cylindrical inner peripheral member (14A); a cylindrical outer peripheral portion (14B) coaxially disposed with respect to the cylindrical inner peripheral member so as to define an annular fluid passage (34) in cooperation with the cylindrical inner peripheral member; and a row of stator vanes (70) arranged circumferentially in the annular fluid passage; wherein each stator vane is provided with a shaft (72) rotatably supported by the cylindrical outer peripheral portion around an axial center line (T) of the shaft, and a vane member (74) supported by the shaft, the axial center line of the shaft being tilted with respect to a radial line (R) emanating radially from a center of the annular fluid passage in a circumferential direction and/or in an axial direction of the annular fluid passage.

Thereby, each vane member is prevented from interfering with the wall surface of the annular fluid passage during the rotational movement of the stator vane while minimizing pressure loss without requiring concave or convex spherical portions to be formed in the wall surface of the annular fluid passage.

According to a preferred embodiment of the present invention, the vane member (74) comprises a root edge (74B), a tip edge (74C), a leading edge (74D) and a trailing edge (74A), and the axial center line of the shaft is tilted in a plane orthogonal to an axial line of the annular fluid passage so that an end point (O) of the root edge on a side of the leading edge is in contact with an inner circumferential surface of the cylindrical outer peripheral portion, and an end point (Q) of the root edge on a side of the trailing edge is in contact with the inner circumferential surface of the cylindrical outer peripheral portion in the non-rated angular position.

Thereby, the tip clearance at the root edge of the stator vane can be minimized by using a highly simple structure.

According to an alternate embodiment, an end point (Ox) of the root edge on a side of the leading edge is spaced from an intersection point (O) of the axial center line of the shaft with an inner circumferential surface of the cylindrical outer peripheral portion by a prescribed distance along the axial center line of the shaft so that an end point (P) of the root edge on a side of the trailing edge is in contact with the inner circumferential surface of the cylindrical outer peripheral portion in the rated angular position, the axial center line of the shaft being tilted in a plane orthogonal to an axial line of the annular fluid passage so that the end point (Q) of the root edge on the side of the trailing edge is in contact with the inner circumferential surface of the cylindrical outer peripheral portion in the non-rated angular position.

Thereby, the tip clearance at the root edge of the stator vane can be minimized by tilting the axial center line of the shaft of the stator vane by a very small angle.

According to a preferred embodiment of the present invention, the vane member (74) comprises a root edge, a tip edge, a leading edge and a trailing edge, and is rotatably supported so as to be rotatable around the axial center line of the shaft between a rated angular position and a non-rated angular position, and an end point (O) of the root edge on a side of the leading edge is in contact with an inner circumferential surface of the cylindrical outer peripheral portion, and wherein the axial center line of the shaft is tilted so that an end point (P) of the root edge on a side of the trailing edge is in contact with the inner circumferential surface of the cylindrical outer peripheral portion in the rated angular position, and the end point (Q) of the root edge on the side of the trailing edge is in contact with the inner circumferential surface of the cylindrical outer peripheral portion in the non-rated angular position.

According to an alternate view point, the vane member has a chord length (L) at the root edge, and the axial center line of the shaft is tilted so as to be orthogonal to a hypothetical plane (S) defined by an intersection point (O) of the axial center line of the shaft with an inner circumferential surface of the cylindrical outer peripheral portion, an intersection of an end point (P) of a line segment having a length equal to the chord length and extending from the intersection point in a direction of the rated angular position with the inner circumferential surface of the cylindrical outer peripheral portion, and an intersection of an end point (Q) of a line segment having a length equal to the chord length and extending from the intersection point in a direction of the non-rated angular position with the inner circumferential surface of the cylindrical outer peripheral portion.

Thereby, each vane member is prevented from interfering with the wall surface of the annular fluid passage during the rotational movement of the stator vane while minimizing pressure loss without requiring concave or convex spherical portions to be formed in the wall surface. In particular, the tip clearance can be minimized both at the rated position and the non-rated position.

Preferably, the root edge extends linearly in a chord direction.

Thereby, the manufacturing cost can be minimized, and the stator vane design is simplified.

Preferably, the leading edge of the vane member is positioned adjacent to the central axial line of the shaft.

Thereby, the clearance between the root edge and the opposing inner circumferential surface of the cylindrical outer peripheral portion can be minimized.

If a part of the root edge is located ahead of the central axial line by any substantial length, such part may be provided with a cutout (74E) so as not to interfere with the inner circumferential surface of the cylindrical outer peripheral portion.

Thereby, the clearance between the root edge and the opposing inner circumferential surface of the cylindrical outer peripheral portion can be minimized.

DESCRIPTION OF THE PREFERRED EMBODIMENT(S)

Preferred embodiments of the present invention are described in the following with reference to the appended drawings.

Figure 1:
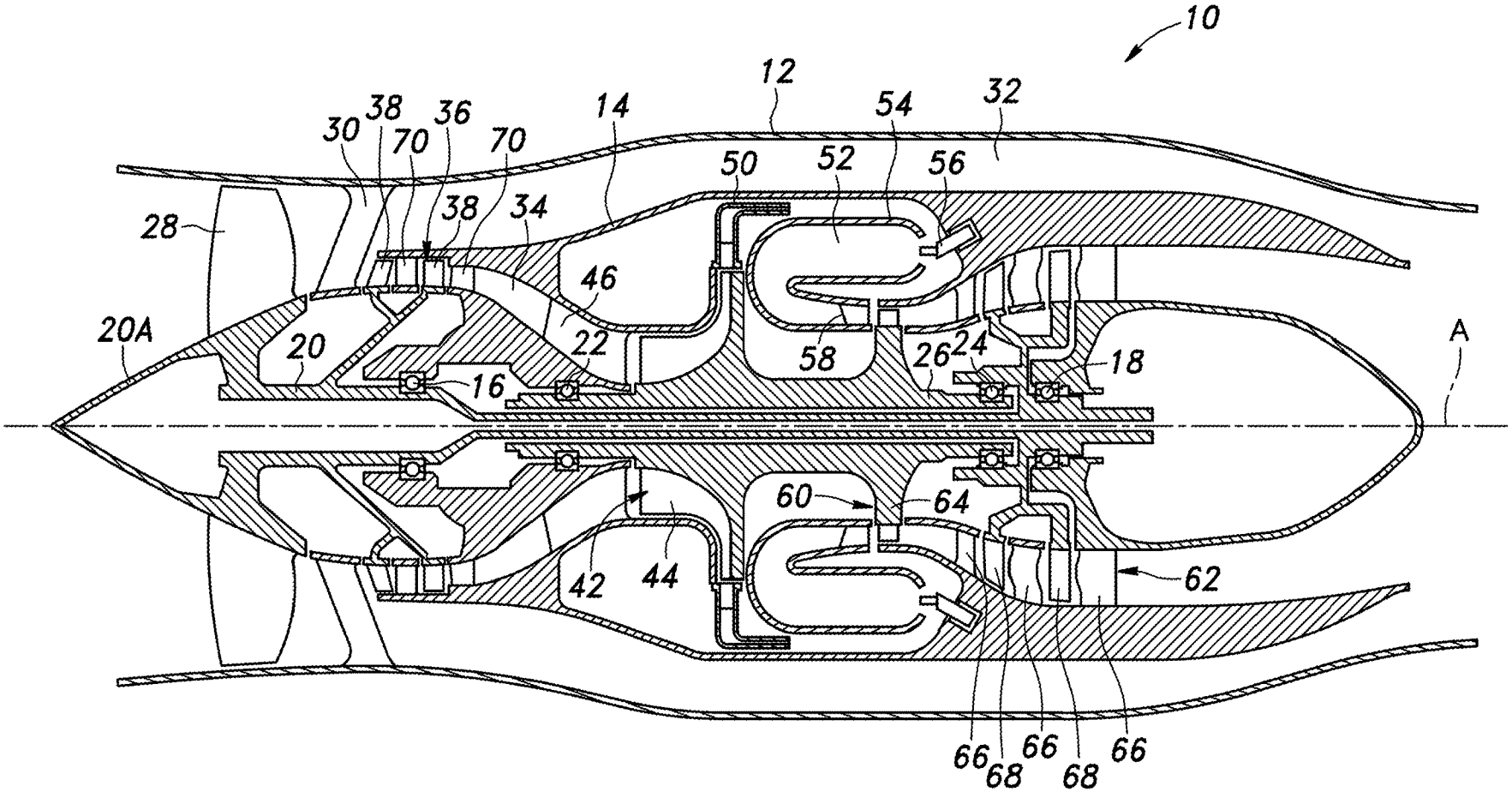
FIG. 1 is a sectional view showing an outline of a gas turbine engine for aircraft employing an axial compressor including a variable stator vane structure according to the present invention.

FIG. 1 shows an outline of a gas turbine engine (turbofan engine) for aircraft using an axial compressor including a variable stator vane structure according to an embodiment of the present invention.

The gas turbine engine 10 is provided with an outer casing 12 and an inner casing 14 which are substantially cylindrical in shape, and are coaxially arranged relative to each other. The inner casing 14 rotatably supports a low pressure rotating shaft 20 via a front first bearing 16 and a rear first bearing 18 fitted on the outer periphery of the low pressure rotating shaft 20. The inner casing 14 also rotatably supports a high pressure rotating shaft 26 consisting of a hollow shaft coaxially receiving the low pressure rotating shaft 20 therein via a front second bearing 22 and a rear second bearing 24 fitted on the outer periphery of the high pressure rotating shaft 26. The common central axial line of the low pressure rotating shaft 20 and the high pressure rotating shaft 26 is indicated by letter A.

The low pressure rotating shaft 20 includes a substantially conical front end portion 20A projecting axially forward from the inner casing 14, and surrounded by a front end part of the outer casing 12. A front fan 28 is provided on the outer periphery of the front end portion 20A. A plurality of stator vanes 30 each having an outer end joined to the outer casing 12 and an inner end joined to the inner casing 14 are provided on the downstream side of the front fan 28 at a regular interval in the circumferential direction. On the downstream side of the stator vane 30, a bypass duct 32 having an annular cross sectional shape is defined between the outer casing 12 and the inner casing 14, and an air compression duct (annular fluid passage) 34 having an annular cross sectional shape is defined inside the inner casing 14 in a coaxial relationship (concentric with the central axial line).

An axial compressor 36 is provided in an inlet part of the air compression duct 34. The axial compressor 36 is provided with two rows of rotor blades 38 extending radially outward from the front end portion 20A of the low pressure rotating shaft 20, and two rows of stator vanes 70 extending radially inward from the inner casing 14 in such a manner that the rows of the stator vanes 70 and the rows of the rotor blades 38 are arranged axially in close proximity and in an alternating manner.

A centrifugal compressor 42 is provided in an outlet part of the air compression duct 34. The centrifugal compressor 42 is provided with an impeller 44 fixedly attached to the outer periphery of the high pressure rotating shaft 26. An additional row of stator vanes 46 are provided downstream of the axial compressor 36 and upstream of the centrifugal compressor 42. A diffuser 50 fixedly attached to the inner casing 14 is provided immediately downstream of the centrifugal compressor 42.

A plurality of reverse-flow combustors 52 are formed on the downstream side of the diffuser 50 to receive compressed air from the diffuser 50. The inner casing 14 is provided with a plurality of fuel injectors 56 for injecting fuel into the reverse-flow combustors 52. The reverse-flow combustors 52 generate high pressure combustion gas by the combustion of the mixture of the fuel and the air. A row of nozzle guide vanes 58 are provided downstream of the reverse-flow combustors 52.

Downstream to the nozzle guide vanes 58 are provided a high pressure turbine 60 and a low pressure turbine 62 in that order. The combustion gas generated by the reverse-flow combustors 52 is forwarded to the high pressure turbine 60 and the low pressure turbine 62. The high pressure turbine 60 includes a high pressure turbine wheel 64 fixed to the outer periphery of the high pressure rotating shaft 26 immediately downstream of the nozzle guide vanes 58. The low pressure turbine 62 includes a plurality of rows of nozzle guide vanes 66 fixedly attached to the inner casing 14 and a plurality of low pressure turbine wheels 68 fixedly attached to the outer periphery of the low pressure rotating shaft 20 so as to alternate with the rows of the nozzle guide vanes 66.

The gas turbine engine 10 is provided with a starter motor (not shown in the drawings) for starting the engine by rotatively driving the high pressure rotating shaft 26. When the high pressure rotating shaft 26 is rotatively driven, the intake air is compressed by the centrifugal compressor 42, and is forwarded to the reverse-flow combustors 52. The fuel injected from the fuel injectors 56 is mixed with the compressed intake air, and combusted in the reverse-flow combustors 52. The produced combustion gas is forwarded to the high pressure turbine wheel 64 and the low pressure turbine wheels 68 to rotatively drive the high pressure and low pressure turbine wheels 64 and 68.

As a result, the low pressure rotating shaft 20 and the high pressure rotating shaft 26 are rotatively driven so as to cause the front fan 19 to be rotated, and the axial compressor 36 and the centrifugal compressor 42 to be operated so that the compressed air is supplied to the reverse-flow combustors 52. Once this cycle is established, the gas turbine engine 10 continues operation even after the starter motor is stopped.

During the operation of the gas turbine engine 10, a part of the air drawn by the front fan 28 passes through the bypass duct 32 and is ejected rearward to create a thrust primarily during low speed flight. The remaining part of the air drawn by the front fan 28 is supplied to the reverse-flow combustors 52, and mixed with the fuel to combust the fuel. The resulting combustion gas rotatively drive the low pressure rotating shaft 20 and the high pressure rotating shaft 26, and is ejected rearward to create a thrust. Details of the stator vanes 70 of the variable vane structure are described in the following with reference to FIGS. 2 and 3.

Figure 2:
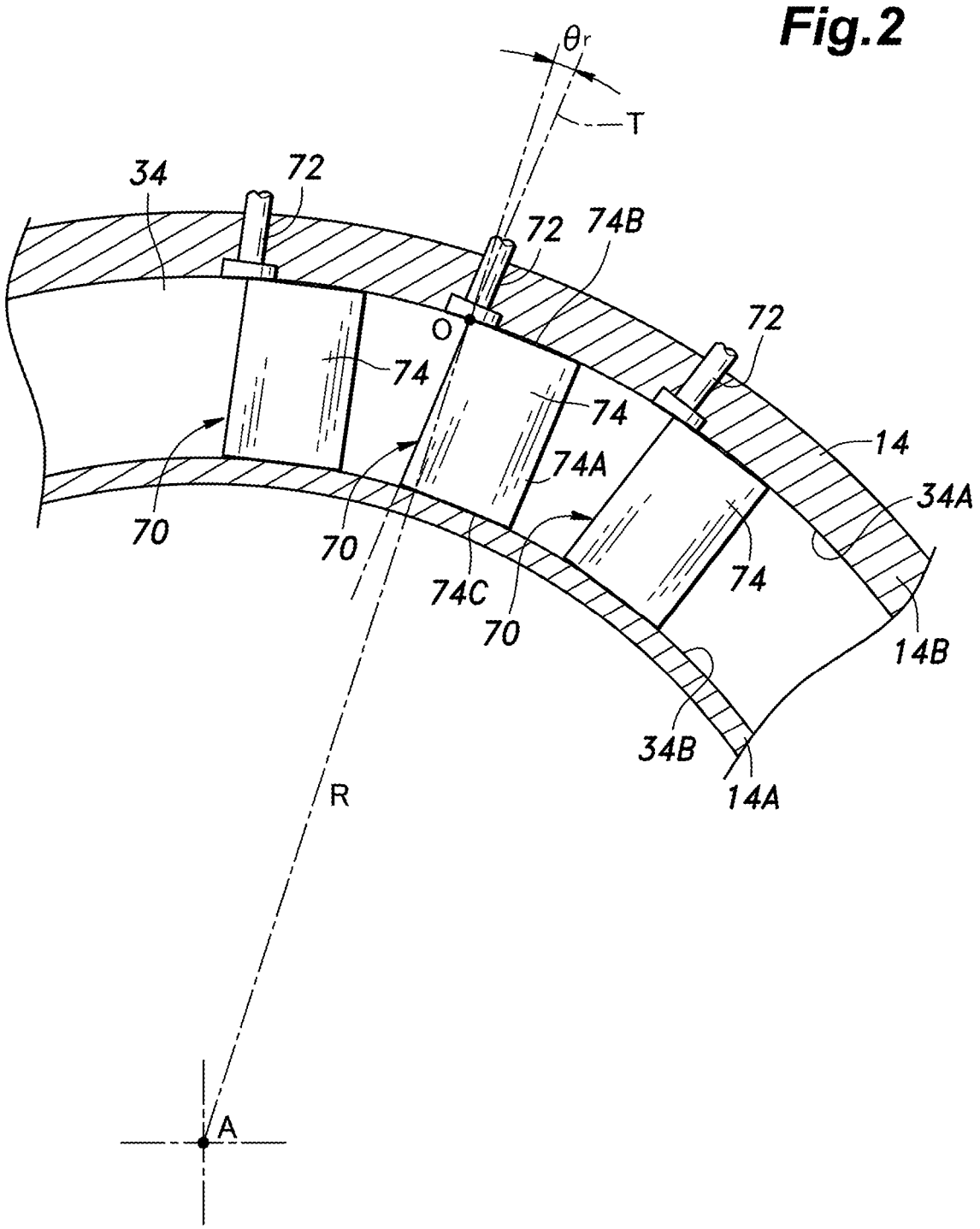
FIG. 2 is a fragmentary cross sectional front view of the variable stator vane structure.

As shown in FIG. 2, the air compression duct (annular fluid passage) 34 is defined as an air passage having an annular cross section by a cylindrical inner peripheral portion 14A of the inner casing 14 and a cylindrical outer peripheral portion 14B of the inner casing 14 coaxially surrounding the cylindrical inner peripheral portion 14A and centered around an axial center line A (see FIG. 1) of the air compression duct 34.

As shown in FIG. 2, the stator vanes 70 are arranged in the circumferential direction of the air compression duct 34 at a prescribed pitch.

Figure 3:
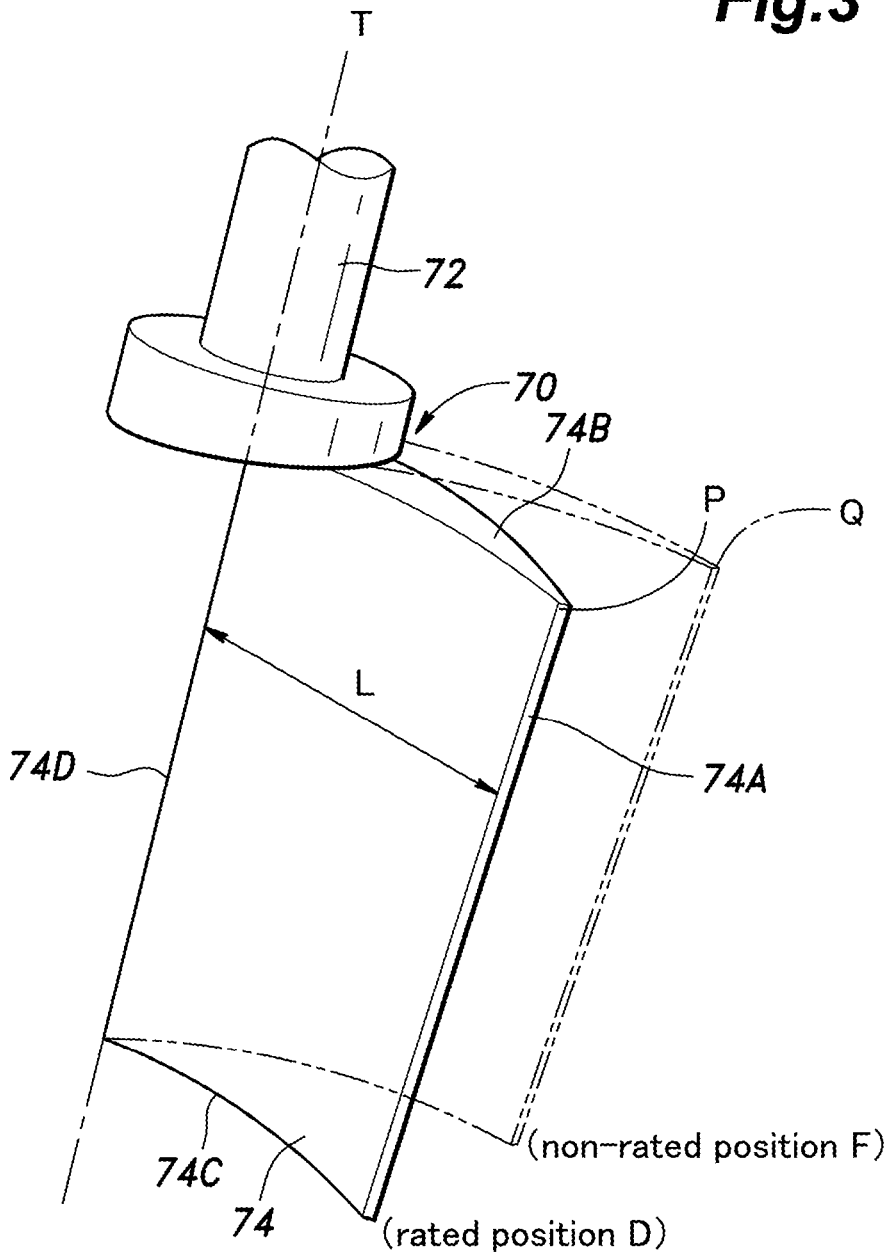
FIG. 3 is a perspective view showing the variable stator vane structure.

Each stator vane 70 is provided with a shaft (pivot shaft) 72 supported by the cylindrical outer peripheral portion 14B so as to be rotatable about the central axial line T thereof (pivotal axis), and a flap-like vane member 74 extending from the shaft 72 in a radial direction with respect to the central axial line X in the air compression duct 34 so as to project radially inward into the air compression duct 34 and be angularly movable between a rated angular position D indicated by the solid lines in FIG. 3 and a non-rated angular position F indicated by the imaginary lines in FIG. 3 around the central axial line T of the shaft 72. In the gas turbine engine 10 for aircraft, the rated angular position corresponds to the angular position or the attack angle of the stator vane 70 suitable for the time of taking off and cruising, and the non-rated angular position corresponds to the angular position or the attack angle of the stator vane 70 suitable for the time of idling or taxiing.

As shown in FIG. 3, the vane member 74 is provided with a substantially linear root edge 74B extending orthogonally to the axial line T of the shaft 72 adjacent to the inner circumferential surface of the cylindrical outer peripheral portion 14B of the inner casing 14, a substantially linear tip edge 74C extending orthogonally to the axial line T of the shaft 72 adjacent to the outer circumferential surface of the cylindrical inner peripheral portion 14A of the inner casing 14, a linear trailing edge 74A extending between the free ends of the root edge 74B and the tip edge 74C in parallel with the axial line T of the shaft 72, and a linear leading edge 74D extending between the base ends of the root edge 74B and the tip edge 74C in parallel with the axial line T of the shaft 72. The tip edge 74C may be defined by an arc or other curved line so as to ensure a small clearance with respect to the outer circumferential surface of the cylindrical inner peripheral portion 14A of the inner casing 14 over an entire range of the angular movement of the vane member 74.

Figure 4A:
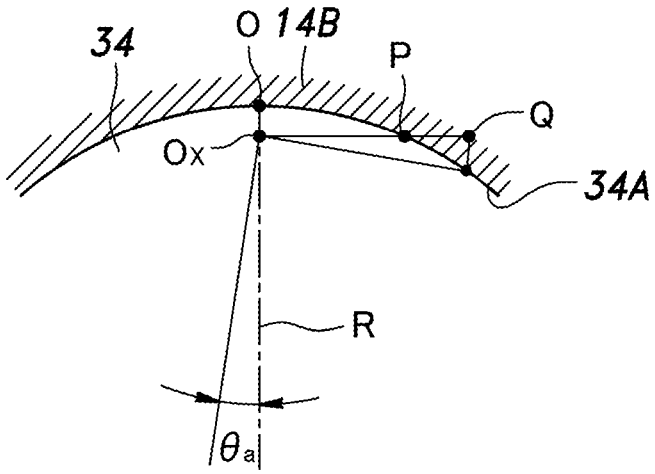
FIG. 4A is a diagram describing the geometry of the variable stator vane structure of a first embodiment.

FIG. 4A is a diagram describing the geometry of the variable stator vane structure of a first embodiment. The base end of the root edge 74B of the vane member 74 is positioned at point Ox which is spaced, along a radial line R of the air compression duct 34 or the axial center line of the shaft 72, from an intersection point O at which the axial line T of the shaft 72 intersects the inner circumferential surface 34A (of the cylindrical outer peripheral portion 14B) defining the air compression duct 34. The distance between O and Ox may be determined such that the free end point P of the root edge 74B on the side of the trailing edge 74A is in contact with the inner circumferential surface 34A of the cylindrical outer peripheral portion 14B in the rated angular position. At this time, the central axial line T of the shaft 72 coincides with the radial line R of the air compression duct 34. Then, the central axial line T is tilted in a plane orthogonal to the axial center line A of the air compression duct 34 by an angle θa such that the free end point Q of the root edge 74B on the side of the trailing edge 74A is in contact with the inner circumferential surface 34A of the cylindrical outer peripheral portion 14B in the non-rated angular position.

Thereby, the root edge 74B of the vane member 74 is prevented from interfering with the inner circumferential surface 34A of the cylindrical outer peripheral portion 14B while minimizing the clearance between the root edge 74B of the vane member 74 and the inner circumferential surface 34A of the cylindrical outer peripheral portion 14B.

Figure 4B:
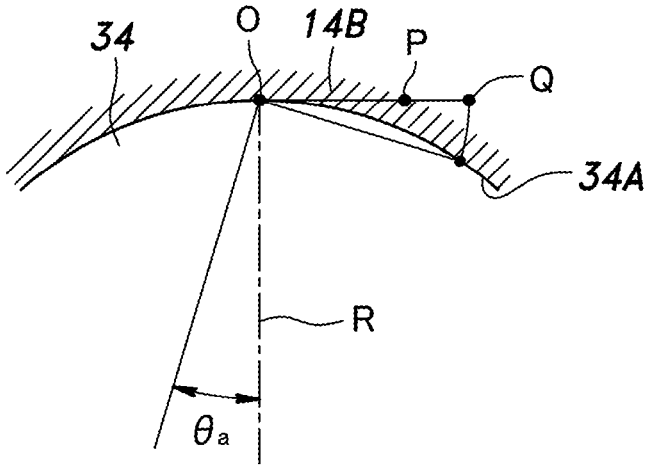
FIG. 4B is a diagram describing the geometry of the variable stator vane structure of a second embodiment.

FIG. 4B is a diagram describing the geometry of the variable stator vane structure of a second embodiment. The base end of the root edge 74B of the vane member 74 is positioned at the intersection point O at which the axial line T of the shaft 72 intersects the inner circumferential surface 34A (of the cylindrical outer peripheral portion 14B) defining the air compression duct 34. Then, the central axial line T is tilted in a plane orthogonal to the axial center line A of the air compression duct 34 by an angle θa such that the free end point Q of the root edge 74B on the side of the trailing edge 74A is in contact with the inner circumferential surface 34A of the cylindrical outer peripheral portion 14B in the non-rated angular position.

Thereby, the root edge 74B of the vane member 74 is prevented from interfering with the inner circumferential surface 34A of the cylindrical outer peripheral portion 14B while minimizing the clearance between the root edge 74B of the vane member 74 and the inner circumferential surface 34A of the cylindrical outer peripheral portion 14B. In particular, according to this embodiment, the clearance between the root edge 74B of the vane member 74 is reduced even further as compared to the first embodiment.

Figure 5A:
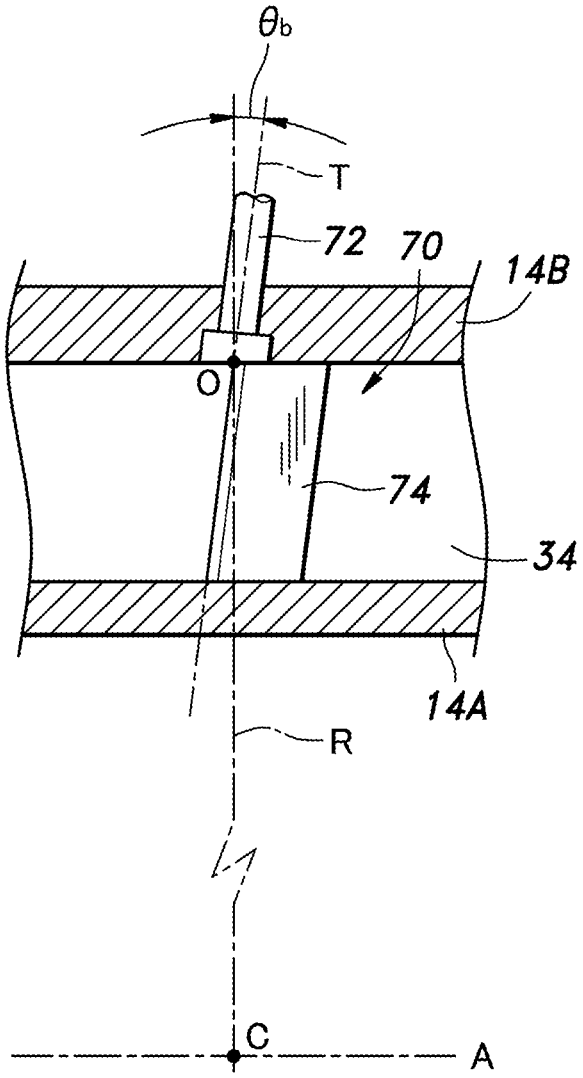
FIG. 5A is a fragmentary sectional side view of the variable vane structure of a third embodiment.
Figure 5B:
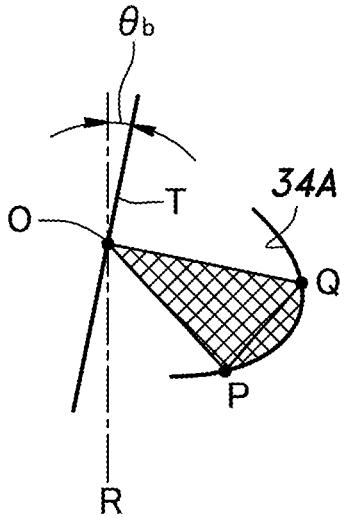
FIG. 5B is a diagram describing the geometry of the variable stator vane structure of the third embodiment.

FIGS. 5A and 5B show a third embodiment of the present invention. The base end of the root edge 74B of the vane member 74 is positioned so as to coincide with an intersection point O at which the axial line T of the shaft 72 intersects the inner circumferential surface 34A (of the cylindrical outer peripheral portion 14B) defining the air compression duct 34. The central axial line T of the shaft 72 is tilted by a three dimensional angle θb both circumferentially and axially with respect to the radial line R so that the free end point P of the root edge 74B on the side of the trailing edge 74A is in contact with the inner circumferential surface 34A of the cylindrical outer peripheral portion 14B in the rated angular position, and the free end point Q of the root edge 74B on the side of the trailing edge 74A is in contact with the inner circumferential surface 34A of the cylindrical outer peripheral portion 14B in the non-rated angular position.

This angle θb can be determined in a slightly different manner. Suppose that the vane member 74 has a chord length L. Then, the central axial line T of the shaft 72 is tilted so as to be orthogonal to a hypothetical plane (S) defined by an intersection point (O) of the central axial line T of the shaft 72 with an inner circumferential surface 34A of the cylindrical outer peripheral portion 14B, an intersection of the end point (P) of a line segment having a length equal to the chord length and extending from the intersection point O in a direction of the rated angular position with the inner circumferential surface 34A of the cylindrical outer peripheral portion 14B, and an intersection of an end point (Q) of a line segment having a length equal to the chord length and extending from the intersection point O in a direction of the non-rated angular position with the inner circumferential surface 34A of the cylindrical outer peripheral portion 14B.

Figure 6:
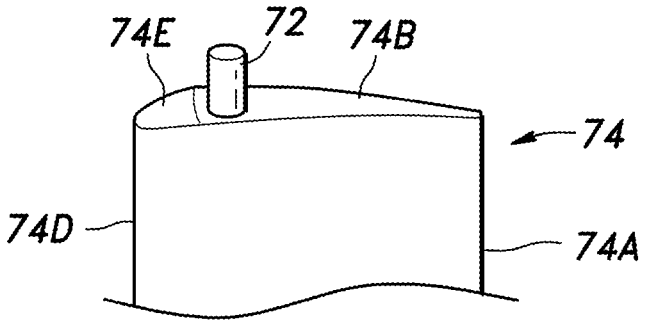
FIG. 6 is a fragmentary perspective view showing a modified embodiment.

In the foregoing embodiments, the leading edge 74D of the vane member 74 is positioned adjacent to the central axial line T of the shaft 72. Therefore, the base end of the root edge 74B on the side of the leading edge 74D does not interfere with the inner circumferential surface 34A of the cylindrical outer peripheral portion 14B as the vane member 74 rotates between the rated angular position and the non-rated angular position. In a modified embodiment shown in FIG. 6, a part of the root edge 74B is located ahead of the central axial line T so that the part of the root edge 74B extending ahead of the central axial line T may interfere with the inner circumferential surface 34A of the cylindrical outer peripheral portion 14B as the vane member 74 rotates between the rated angular position and the non-rated angular position if the root edge 74B is linear in shape, and no measure is taken. Therefore, in this modified embodiment, the part of the root edge 74B extending ahead of the central axial line T is provided with a cutout 74E so as not to interfere with the inner circumferential surface 34A of the cylindrical outer peripheral portion 14B as the vane member 74 rotates between the rated angular position and the non-rated angular position.

According to the foregoing embodiments, the pressure loss during the rated operation can be reduced without increasing the manufacturing cost or creating new causes for pressure loss so that the maximum output of the gas turbine engine 10 can be improved by means of an improvement in the performance of the axial compressor 36.

Although the present invention has been described in terms of specific embodiments, the present invention is not limited by such embodiments, but can be appropriately modified without departing from the spirit of the present invention. For example, the direction of the inclination of the axial line T of the shaft 72 with respect to the radial line R is not limited to those discussed above, but may be any combination of the circumferential direction and the axial direction of the air compression duct 34 including the case of a purely in the circumferential direction of the air compression duct 34.

The variable stator vane structure according to the present invention is not limited to the low pressure axial compressor of a gas turbine engine, but may consist of any type of axial compressor such as the high pressure axial compressor of a gas turbine engine among other possibilities.

The invention claimed is:

1. A variable stator vane structure of an axial compressor, comprising:

a cylindrical inner peripheral member;

a cylindrical outer peripheral portion coaxially disposed with respect to the cylindrical inner peripheral member so as to define an annular fluid passage in cooperation with the cylindrical inner peripheral member; and a row of stator vanes arranged circumferentially in the annular fluid passage;

wherein each stator vane is provided with a shaft rotatably supported by the cylindrical outer peripheral portion around an axial center line of the shaft, and a vane member supported by the shaft, the axial center line of the shaft being tilted with respect to a radial line emanating radially from a center of the annular fluid passage in a circumferential direction and/or in an axial direction of the annular fluid passage, the vane member comprises a root edge, a tip edge, a leading edge and a trailing edge, and is rotatably supported so as to be rotatable around the axial center line of the shaft between a rated angular position and a non-rated angular position, the rated angular position being associated with taking off and cruising operation modes, and the non-rated angular position being associated with idling and taxiing operation modes, and the axial center line of the shaft is tilted in a plane orthogonal to an axial line of the annular fluid passage so that an end point of the root edge on a side of the leading edge is in contact with an inner circumferential surface of the cylindrical outer peripheral portion, and an end point of the root edge on a side of the trailing edge is in contact with the inner circumferential surface of the cylindrical outer peripheral portion in the non-rated angular position.

2. The variable stator vane structure according to claim 1, wherein the end point of the root edge on the side of the leading edge is spaced from an intersection point of the axial center line of the shaft with the inner circumferential surface of the cylindrical outer peripheral portion by a prescribed distance along the axial center line of the shaft so that the end point of the root edge on the side of the trailing edge is in contact with the inner circumferential surface of the cylindrical outer peripheral portion in the rated angular position.

3. The variable stator vane structure according to claim 1, wherein the axial center line of the shaft is tilted so that the end point of the root edge on the side of the trailing edge is in contact with the inner circumferential surface of the cylindrical outer peripheral portion in the rated angular position.

4. The variable stator vane structure according to claim 1, wherein the vane member having a chord length L at the root edge, and the axial center line of the shaft is tilted so as to be orthogonal to a hypothetical plane defined by an intersection point of the axial center line of the shaft with the inner circumferential surface of the cylindrical outer peripheral portion, an intersection of an end point of a line segment having a length equal to the chord length and extending from the intersection point in a direction of the rated angular position with the inner circumferential surface of the cylindrical outer peripheral portion, and an intersection of an end point of a line segment having a length equal to the chord length and extending from the intersection point in a direction of the non-rated angular position with the inner circumferential surface of the cylindrical outer peripheral portion.

5. The variable stator vane structure according to claim 4, wherein the root edge extends linearly in a chord direction.

6. The variable stator vane structure according to claim 1, wherein the leading edge of the vane member is positioned adjacent to the axial center line of the shaft.

7. The variable stator vane structure according to claim 1, wherein a part of the root edge located ahead of the axial center line is provided with a cutout so as not to interfere with the inner circumferential surface of the cylindrical outer peripheral portion.

* * * * *